US011133573B2

(12) United States Patent
Chen

(10) Patent No.: US 11,133,573 B2
(45) Date of Patent: Sep. 28, 2021

(54) MOBILE TERMINAL ANTENNA AND MOBILE TERMINAL

(71) Applicant: VIVO MOBILE COMMUNICATION CO., LTD., Guangdong (CN)

(72) Inventor: Yuwen Chen, Chang'an Dongguan (CN)

(73) Assignee: VIVO MOBILE COMMUNICATION CO., LTD., Chang'an Dongguan (CN)

( * ) Notice: Subject to any disclaimer, the term of this patent is extended or adjusted under 35 U.S.C. 154(b) by 101 days.

(21) Appl. No.: 16/499,085

(22) PCT Filed: Dec. 28, 2017

(86) PCT No.: PCT/CN2017/119236
§ 371 (c)(1),
(2) Date: Sep. 27, 2019

(87) PCT Pub. No.: WO2018/176948
PCT Pub. Date: Oct. 4, 2018

(65) Prior Publication Data

US 2020/0058983 A1 Feb. 20, 2020

(30) Foreign Application Priority Data

Mar. 28, 2017 (CN) ..... 201710191650.2

(51) Int. Cl.
*H01Q 1/24* (2006.01)
*H01Q 1/36* (2006.01)
*H01Q 1/48* (2006.01)

(52) U.S. Cl.
CPC ..... *H01Q 1/243* (2013.01); *H01Q 1/36* (2013.01); *H01Q 1/48* (2013.01)

(58) Field of Classification Search
CPC ..... H01Q 1/243; H01Q 1/36; H01Q 1/42; H01Q 1/48; H01Q 1/521; H01Q 1/52;
(Continued)

(56) References Cited

U.S. PATENT DOCUMENTS 9,972,891 B2 * 5/2018 Ayala Vazquez ..... H01Q 5/378
10,186,755 B2 * 1/2019 Xiong ..... H01Q 5/50
(Continued)

FOREIGN PATENT DOCUMENTS

CN 102522625 A 6/2012
CN 103034291 A 4/2013
(Continued)

OTHER PUBLICATIONS

EP Search Report in Application No. 17903936.7 dated Mar. 16, 2020.
(Continued)

*Primary Examiner* — Tho G Phan
(74) *Attorney, Agent, or Firm* — Maschoff Brennan

(57) ABSTRACT

Mobile terminal antenna and mobile terminal are provided. Mobile terminal antenna includes: main ground board, isolation sheet and metal frame surrounding main ground board; main ground board is within metal frame, part of edge of which is connected with inner edge of metal frame and another part of edge of which is separated from inner edge of metal frame; metal frame includes first section and second section, inner edge of metal frame corresponding to first section is connected with edge of main ground board, inner edge of metal frame corresponding to second section is separated from edge of main ground board; opening is provided in second section, portions of metal frame on sides of opening are connected with grounding terminal and feed, so portions each form antenna arm; isolation sheet is in opening and connected with grounding terminal. Mobile terminal includes any described mobile terminal antenna.

18 Claims, 5 Drawing Sheets

(58) Field of Classification Search
CPC ..... H01Q 21/28; H01Q 1/242; H01Q 1/24; H01Q 1/44; H01Q 1/50
See application file for complete search history.

(56) References Cited

U.S. PATENT DOCUMENTS

| | | | | |
|---|---|---|---|---|
| 10,218,065 | B2 * | 2/2019 | Lee | H01Q 5/328 |
| 10,622,702 | B2 * | 4/2020 | Guo | H01Q 1/44 |
| 10,644,382 | B2 * | 5/2020 | Lee | H01Q 9/42 |
| 10,720,695 | B2 * | 7/2020 | Yu | H01Q 21/28 |
| 2013/0016024 | A1 | 1/2013 | Shi et al. | |
| 2013/0050057 | A1 | 2/2013 | Hayashi et al. | |
| 2013/0088397 | A1 | 4/2013 | Mo et al. | |
| 2015/0084831 | A1 | 3/2015 | Liu et al. | |

FOREIGN PATENT DOCUMENTS

| | | | |
|---|---|---|---|
| CN | 103346397 | A | 10/2013 |
| CN | 103650239 | A | 3/2014 |
| CN | 105140623 | A | 12/2015 |
| CN | 105811076 | A | 7/2016 |
| CN | 105870629 | A | 8/2016 |
| CN | 104103888 | B | 9/2016 |
| CN | 106887678 | A | 6/2017 |
| CN | 107257016 | A | 10/2017 |
| CN | 107257017 | A | 10/2017 |
| CN | 107257022 | A | 10/2017 |
| CN | 107257023 | A | 10/2017 |
| CN | 107275760 | A | 10/2017 |
| WO | 2015096101 | A1 | 7/2015 |

OTHER PUBLICATIONS

CN Office Action in Application No. 201710191650.2 dated Aug. 13, 2018.
CN Search Report in Application No. 201710191650.2 dated Mar. 9, 2018.
Xin et al., "Wi-Fi" Digital Communication, vol. 41, No. 6, Dec. 25, 2014.
Written Opinion and International Search Report in Application No. PCT/CN2017/119236 dated Oct. 10, 2019.

* cited by examiner

MOBILE TERMINAL ANTENNA AND MOBILE TERMINAL

CROSS-REFERENCE TO RELATED APPLICATION

This application is the U.S. national phase of PCT Application No. PCT/CN2017/119236 filed on Dec. 28, 2017, which claims a priority to Chinese Patent Application No. 201710191650.2 filed on Mar. 28, 2017, the disclosures of which are incorporated in their entirety by reference herein.

TECHNICAL FIELD

The present disclosure relates to the field of electronic device, in particular to a mobile terminal antenna and a mobile terminal.

BACKGROUND

A mobile phone antenna is a device for receiving signals in a mobile phone, an old-fashioned mobile phone is provided with an outward protruding antenna, and an antenna of a new mobile phone is usually hidden in the phone body. In the related technologies, an opening is formed on a metal housing or a middle frame of the mobile phone, to generate antenna radiation signals by metal end on two sides of the opening, and a grounding point is provided in a preset position of the metal housing or the middle frame, so that a part of the metal housing or the middle frame between the grounding point and the opening forms an antenna arm. In the related technologies, an electric field strength is high when the part on one side of the opening is used as an antenna arm to generate antenna radiation signals at the end thereof, and it is easy to couple a part of the metal housing or the middle frame on the other side of the opening, which causes a problem of poor isolation. In view of this, only a part of the metal housing or the middle frame on one side of the opening is used to generate antenna radiation generally, and a part of the metal housing or the middle frame on the other side has to be grounded. Therefore, there has to be a one-to-one correspondence between the opening and antenna for mobile terminal antennas in the related technologies. As shown in FIG. 7, when only one opening 702 is provided in a frame 701 of a meta housing 700, only one of a frame 7011 on the left side of the opening 702 and a frame 7012 on the right side of the opening 702 can serve as an antenna arm. For example, in FIG. 7, the frame 7011 on the left side of the opening 702 is connected to a feed 703 to become an antenna arm. The antenna arm is connected to a main ground board 704 at one end thereof away from the opening 702, and is grounded via the main ground board 704, so that only one antenna arm is formed in the metal housing 700. Only one of the frames on both sides of the opening 702 can be used as an antenna arm, and the utilization rate of the opening and the metal frame is low.

In the related technologies, there is also another technology of mobile phone antenna, in which the metal housing or the frame on each side of the opening is not grounded, the metal housing or frame on one side of the opening is used to generate antenna radiation signals, thus forming an antenna arm, and the metal housing or frame on the other side of the opening also generates antenna radiation signals as a parasitic sheet, whereas the parasitic sheet cannot be used as an antenna arm. In this way, the metal housing or frame on both sides of the opening can be used to generate antenna radiation signals, however, there is only one feed-in and only one antenna can be formed. There is still a problem of low utilization rate of the opening and metal frame.

SUMMARY

A mobile terminal antenna and a mobile terminal are provided according to the present disclosure, to solve the technical problem of low utilization rate of antenna at two sides of an opening in a mobile phone antenna.

In a first aspect, a mobile terminal antenna is provided according to the present disclosure. The mobile terminal antenna includes: a main ground board, an isolation sheet, and a metal frame surrounding the main ground board, where the main ground board is arranged within the metal frame;

the metal frame includes a first section and a second section, an inner edge of the metal frame corresponding to the first section is connected with an edge of the main ground board, an inner edge of the metal frame corresponding to the second section is separated from the edge of the main ground board, at least one opening is provided in the second section, portions of the metal frame on two sides of each opening are each connected with a grounding terminal and a feed, such that the portions of the metal frame on the two sides of the opening each form at least one antenna arm; and the isolation sheet is arranged in the opening and connected with the grounding terminal.

In a second aspect, a mobile terminal is provided according to the present disclosure, which includes a mobile terminal antenna. The mobile terminal antenna includes:

a main ground board, an isolation sheet, and a metal frame surrounding the main ground board, where the main ground board is arranged within the metal frame;

the metal frame includes a first section and a second section, an inner edge of the metal frame corresponding to the first section is connected with an edge of the main ground board, an inner edge of the metal frame corresponding to the second section is separated from the edge of the main ground board, at least one opening is provided in the second section, portions of the metal frame on two sides of each opening are each connected with a grounding terminal and a feed, such that the portions of the metal frame on the two sides of the opening each form at least one antenna arm; and the isolation sheet is arranged in the opening and connected with the grounding terminal.

BRIEF DESCRIPTION OF THE DRAWINGS

To illustrate the technical solutions in the embodiments of the present disclosure more clearly, drawings used in description of the embodiments are briefly introduced hereinafter. It is apparent that the accompanying drawings in the following description merely show some embodiments of the present disclosure, and a person of ordinary skill in the art can derive other drawings from these accompanying drawings without creative efforts.

DETAILED DESCRIPTION

The technical solutions in embodiments of the present disclosure are described clearly and completely in conjunction with drawings in the embodiments of the present disclosure. Apparently, the described embodiments are merely a part of rather than all the embodiments of the present disclosure. All other embodiments obtained by a person ordinary skilled in the art based on the embodiments of the present disclosure without any creative efforts fall within the protection scope of the present disclosure.

Figure 1:
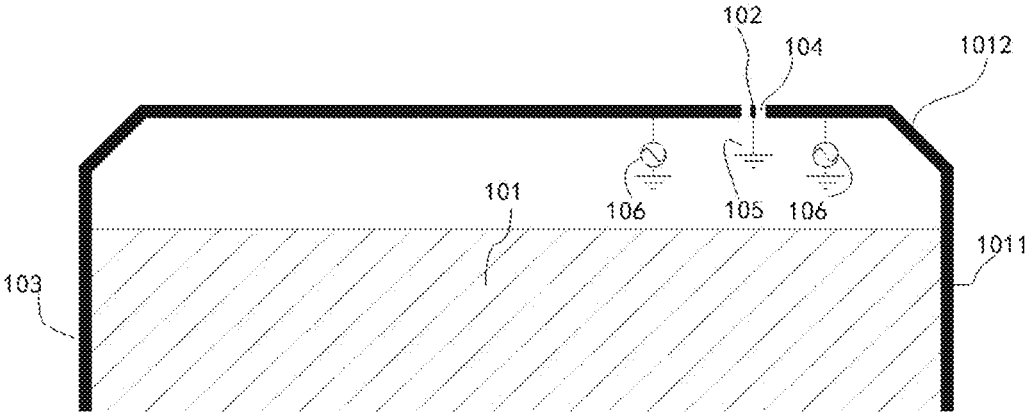
FIG. 1 is a schematic structural diagram of a mobile terminal antenna according to some embodiments of the present disclosure.

A mobile terminal antenna as shown in FIG. 1 is provided according to some embodiments of the present disclosure. The mobile terminal antenna includes a main ground board 101, an isolation sheet 102 and a metal frame 103 surrounding the main ground board 101.

The main ground board 101 is arranged within the metal frame 103, a part of an edge of the main ground board 101 is connected with an inner edge of the metal frame 103, and another part of the edge is separated from the inner edge of the metal frame 103. Substantially, the main ground board 101 and the metal frame 103 are coplanar with each other.

The metal frame 103 includes a first section 1011 connected with the main ground board 101 and a second section 1012 separated from the main ground board 101. The inner edge of the metal frame 103 corresponding to the first section 1011 is connected with the edge of the main ground board 101, and the inner edge of the metal frame 103 corresponding to the second section 1012 is separated from the edge of the main ground board 101 (i.e., there is a gap between the second section 1012 and the edge of the metal frame 103). At least one opening 104 is provided in the second section 1012, and there is a clearance region between the second section 1012 and the main ground board 101. Portions of the metal frame 103 on two sides of each opening 104 are each connected with a grounding terminal 105 and a feed 106, so that the portions of the metal frame on the two sides of the opening 104 each form at least one antenna arm to radiate antenna signals. Specifically, the first section 1011 is a part of the metal frame 103, the second section 1012 is other part of the metal frame 103, and two ends of the first section 1011 are connected with two ends of the second section 1012.

The isolation sheet 102 is arranged in the opening 104 and connected with the grounding terminal 105.

Figure 6A:
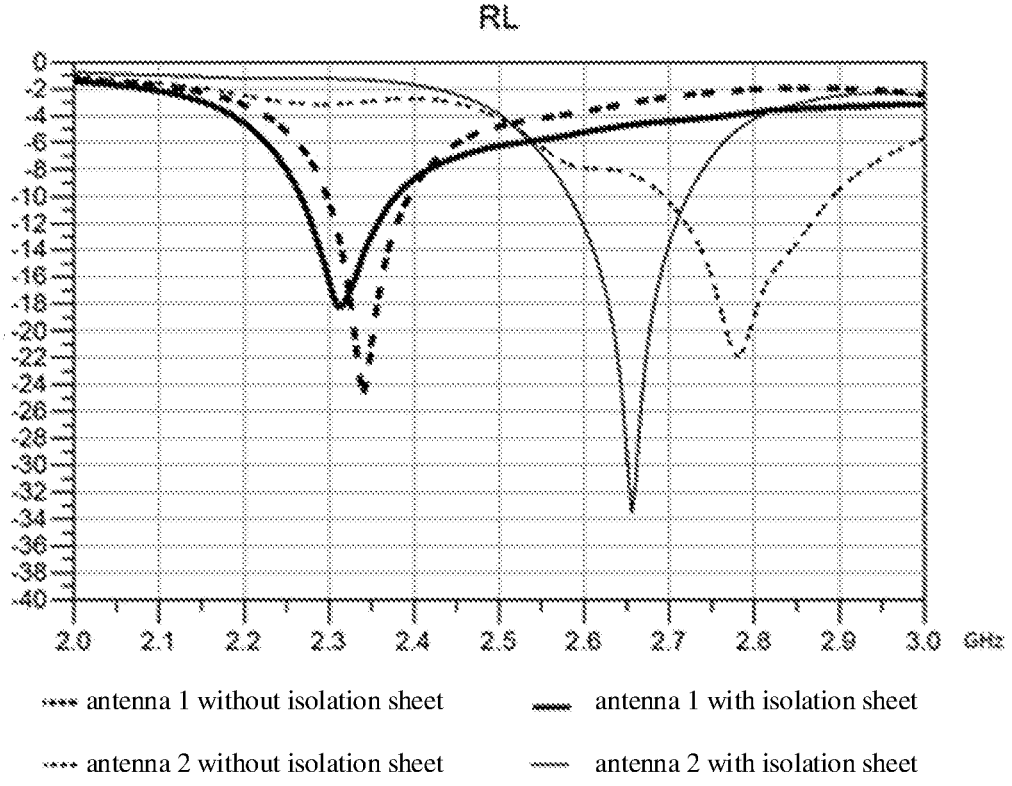
FIG. 6A is a graph showing comparison between antenna return losses of antennas with isolation sheet and antennas without isolation sheet.
Figure 6B:
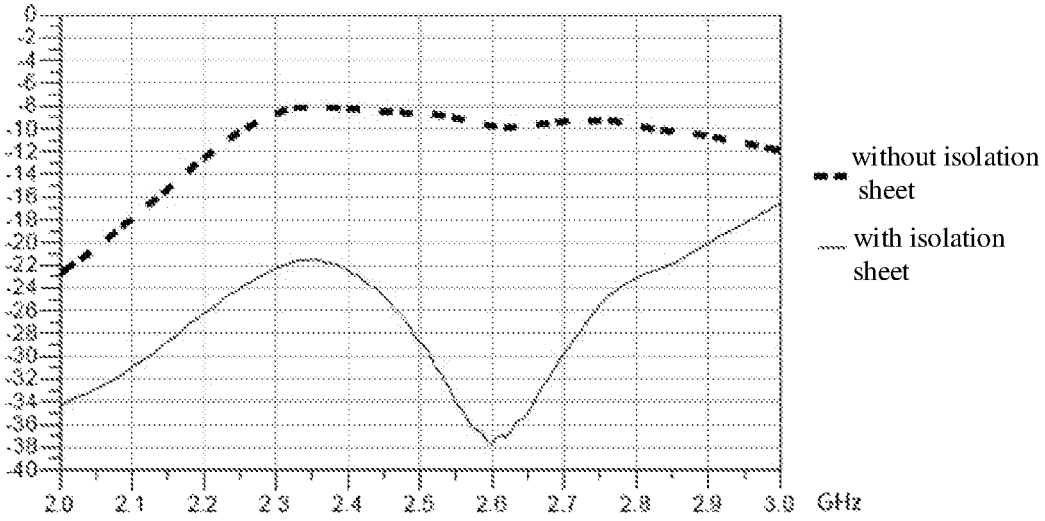
FIG. 6B a graph showing comparison between isolation of antenna with isolation sheet and antenna without isolation sheet.
Figure 6C:
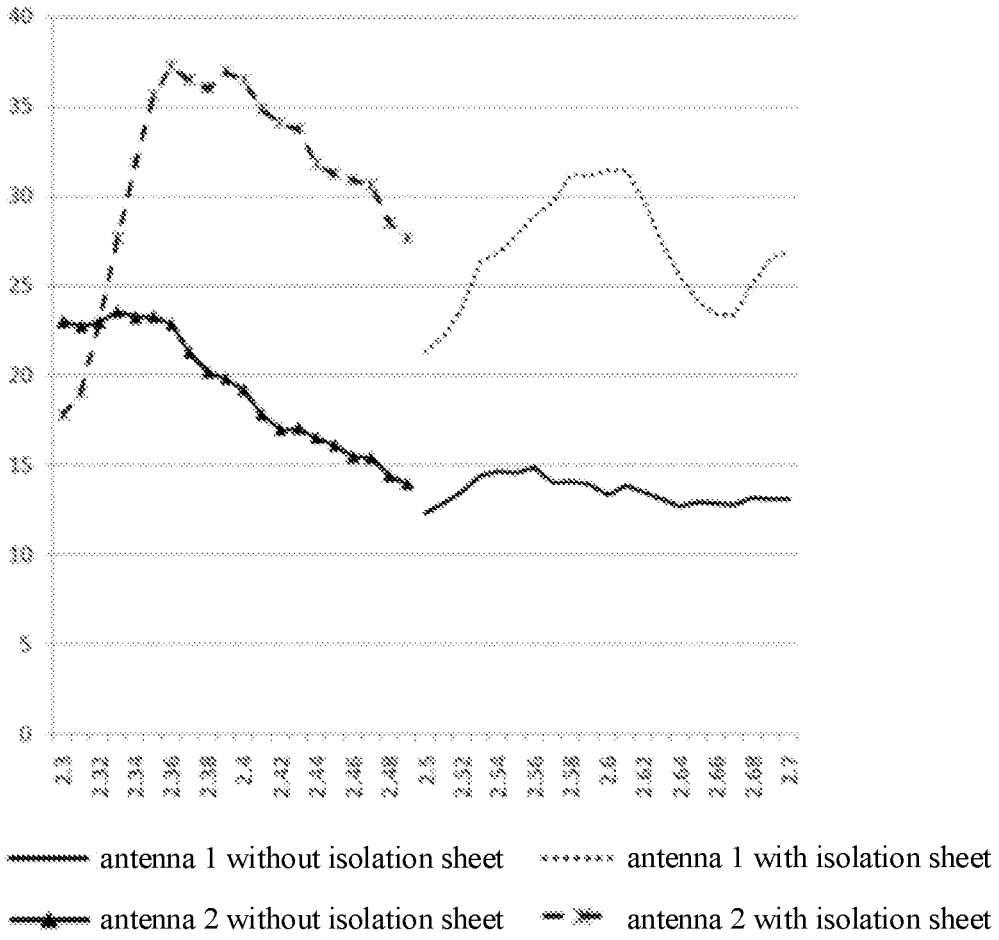
FIG. 6C a graph showing comparison between antenna efficiencies of antennas with isolation sheet and antennas without isolation sheet.
Figure 7:
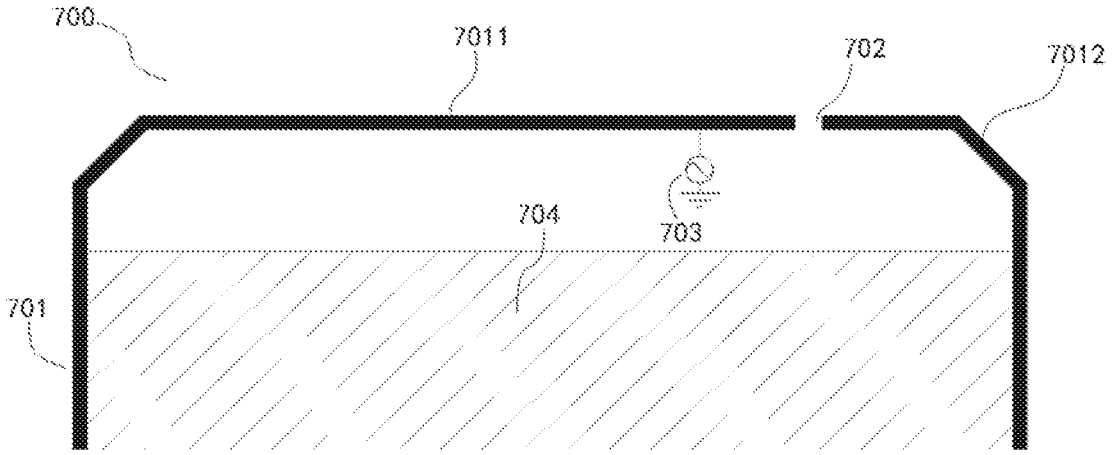
Fig. 7 (Prior art)
FIG. 7 is a schematic diagram of an antenna in the related technologies.

As can be seen from the above, in the mobile terminal antenna according to the embodiments of the present disclosure, the sections of the metal frame function as the antenna arms, and the opening is provided between the antenna arms, ensuring radiation performance of the antenna arms. The opening, however, is equivalent to a coupling capacitor, which renders energy coupling between metal frame portions on two sides of the opening, as a result of which poor isolation is caused between the antenna arms on two sides of the opening, affecting antenna efficiency. Based on the embodiments of the present disclosure, the isolation sheet is provided in the opening of the metal frame, improving isolation effect between the portions of the metal frame on two sides of the opening, so that the portions of the metal frame on both sides of the opening can function as antenna arms. FIG. 6A is a graph showing antenna return losses of antennas with isolation sheet and antennas without isolation sheet. It can be seen from FIG. 6A that return losses (RL) of the antennas with isolation sheet are substantially smaller than those of the antennas without isolation sheet. As can be seem from FIG. 6B which shows comparison between isolation of antenna with isolation sheet and antenna without isolation sheet, the isolation of the antenna with isolation sheet is significantly higher than that of the antenna without isolation sheet. Besides, as can be seen from FIG. 6C which shows comparison between antenna efficiencies of antennas with isolation sheet and antennas without isolation sheet, the efficiencies of the antennas with isolation sheet are significantly higher than those of the antennas without isolation sheet.

Thus, based on the embodiments of the present disclosure, the quantity of antenna arms is increased, while the quantity of openings or metal frames is not increased and antenna radiation performance is guaranteed, thereby increasing the quantity of antenna and improving antenna efficiency. In addition, isolation effect between the antenna arms is guaranteed by arranging the isolation sheet, so that usage of the antenna arms is hardly adversely influenced by increase of the quantity of antenna arms.

In an embodiment of the present disclosure, the feed is a location where a feed line is connected with the antenna. The feed line is a transmission line by which a radio frequency front end is connected with the antenna.

In an embodiment of the present disclosure, optionally, the isolation sheet is made of a metal material. Specifically, a cross section of the isolation sheet is substantially the same as a cross section of each of the metal arms at two sides of the isolation sheet, and the isolation sheet may be metal substance additionally inlayed in the opening of the metal frame or may be a part of the metal frame removed when forming the opening. Cross sectional area of the isolation sheet corresponding to the antenna arms on two sides is slightly smaller than cross sectional area of the antenna arms on two sides, and the gaps are filled with a nonmetal material to wrap the isolation sheet so that it looks like one gap.

In an embodiment of the present disclosure, optionally, the metal frame is a part of a middle frame or a metal housing of a mobile terminal.

In an embodiment of the present disclosure, the main ground board serves as an equivalent grounding terminal. The isolation sheet and/or at least one antenna arm is grounded by being connected with the main ground board.

Optionally, the isolation sheet and/or at least one antenna arm is connected with a motherboard via a dome sheet and is further connected to the main ground board via the motherboard. At least one other device of the mobile terminal is connected in a grounding path of the isolation sheet and/or at least one antenna arm.

Figure 5:
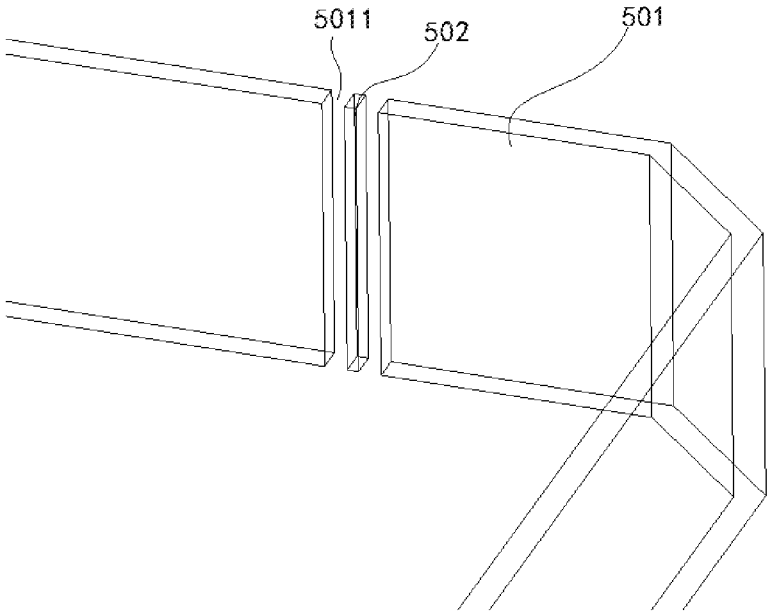
FIG. 5 is a schematic stereoscopic structural diagram of a mobile terminal antenna according to some embodiments of the present disclosure.

Optionally, the metal frame is a metal frame arranged on a motherboard (PCB) of the mobile terminal, or, as shown in FIG. 5, the metal frame is a metal middle frame 501 of the mobile terminal. An opening 5011 is provided in the metal middle frame 501, an isolation sheet 502 is provided in the opening 5011, and a cross sectional shape of the isolation sheet 502 is matched with a cross sectional shape of the metal middle frame 501.

Specifically, the main ground board includes a motherboard (PCB) and a large whole piece of metal, generates an induced current with an antenna radiation body and serves as a reference ground of the antenna.

Figure 2:
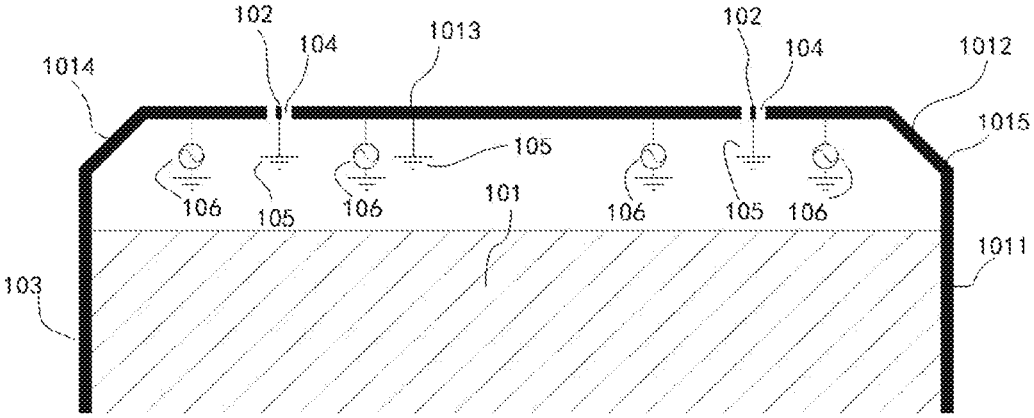
FIG. 2 is a schematic structural diagram of a mobile terminal antenna according to some embodiments of the present disclosure.

In the embodiments of the present disclosure, the opening is provided in part of the metal frame and the isolation sheet is provided in the opening, so that isolation between two sides of the opening is improved, and the portions of the metal frame on both sides of the opening can function as antennas in a case that a grounding terminal is provided at each side of the opening, thereby improving antenna length without increasing the quantity of openings or metal frames. Since the portions of the metal frame on both sides of the opening can function as antenna arms, more antenna arms can be formed with a certain quantity of openings, improving utilization rate of metal frame and opening, so that the mobile terminal can better meet the development requirement of multi-antenna mobile terminal. A mobile terminal antenna as shown in FIG. 2 is provided according to some embodiments of the present disclosure. In a case that two or more openings 104 are provided in the mobile terminal antenna, a grounding point 1013 is provided on a portion of the metal frame between two neighboring openings 104. The grounding point 1013 is connected with the grounding terminal 105, so that the portions of the metal frame 103 between two neighboring openings 104 is divided by the grounding point to form two antenna arms.

In the related technologies, N opening are required for forming N antennas in a mobile terminal with a metal housing or a middle frame. With the development of 5G technology, more antennas, such as four or eight, are required in a mobile terminal, and taken into account of GPS and WIFI antennas in a mobile phone, more than six openings may be required in the entire mobile terminal, resulting in a poor appearance of the mobile terminal. In the above embodiments of the present disclosure, as the metal frame portions on both sides of the opening of the antenna can function as antenna arms, 2N antennas can be formed when N openings are provided, further improving utilization rate of the metal frame.

Optionally, a portion of the second section of the metal frame between two neighboring openings may be structurally detached from other part of the metal frame. As an opening is provided at each end of the portion of the second section, a grounding point may be provided on the portion of the second section of the metal frame between neighboring openings, the portion of the second section of the metal frame between the neighboring openings is divided by the grounding point to form two antenna arms, and parts of the second section of the metal frame near the openings serve as radiation ends of the antenna arms.

Optionally, at least one antenna arm is connected with the main ground board via the first section of the metal frame, so that the main ground board serves as an equivalent grounding terminal of the at least one antenna arm, which functions as a grounding terminal.

With reference to FIG. 2 again, antenna arms 1014 and 1015 are connected with the first section of the metal frame, connected with the main ground board 101 via the first section of the metal frame, and grounded via the main ground board 101.

Optionally, with continued reference to FIG. 2, a thickness d of the isolation sheet 102 is smaller than 1 mm. preferably, the thickness d of the isolation sheet is smaller than 0.5 mm. The small thickness of the isolation sheet makes the mobile terminal beautiful and as well effectively avoids generation of resonance.

Optionally, to guarantee the performance of isolation, a distance between the isolation sheet and the antenna arm at each side of the isolation sheet needs to be as large as possible, and in order to minimize a total width of the gap, the thickness of the isolation sheet may be further reduced, for example, to less than 0.5 mm.

Optionally, the distance between the isolation sheet and the antenna arm at each side of the isolation sheet is greater than 0.5 mm.

As each antenna arm in the mobile terminal serves its own purpose, it is very important to guarantee isolation between the antenna arms. Optionally, in order to improve the performance of isolation of the isolation sheet, a resonant frequency of each isolation sheet and its grounded part is higher than a maximum operation frequency of the antenna at each side of the isolation sheet.

Optionally, to ensure that the resonant frequency of the isolation sheet and its grounded part is higher than the maximum operation frequency of the antenna at each side of the isolation sheet, a path connecting the isolation sheet to the grounding terminal is shorter than a path connecting the antenna arm to the grounding terminal.

Optionally, the isolation sheet is made of metal, an insulation layer is provided surrounding the isolation sheet, and the isolation sheet is wrapped by the insulation layer, further guaranteeing the performance of isolation of the isolation sheet.

Optionally, a cross sectional area of the isolation sheet is not greater than an area of an end of the second section of the metal frame one two sides of the opening, and the isolation sheet is not extended from the opening, to guarantee beauty of the mobile terminal. With the isolation sheet not extended from the second section of the metal at the opening, the center of the isolation sheet may deviate from the center of an end surface of the second section of the metal frame at the opening.

Optionally, the isolation sheet, the main ground board and the first section of the metal frame are integrally formed, and two ends of the first section of the metal frame and respective closest antenna arms are integrally formed.

Figure 3A:
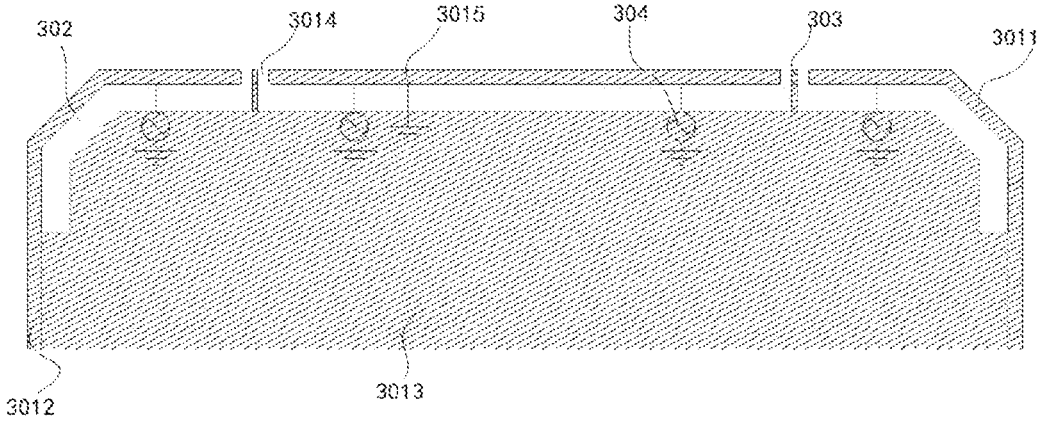
FIG. 3A is a schematic structural diagram of a mobile terminal antenna according to some embodiments of the present disclosure.
Figure 3B:
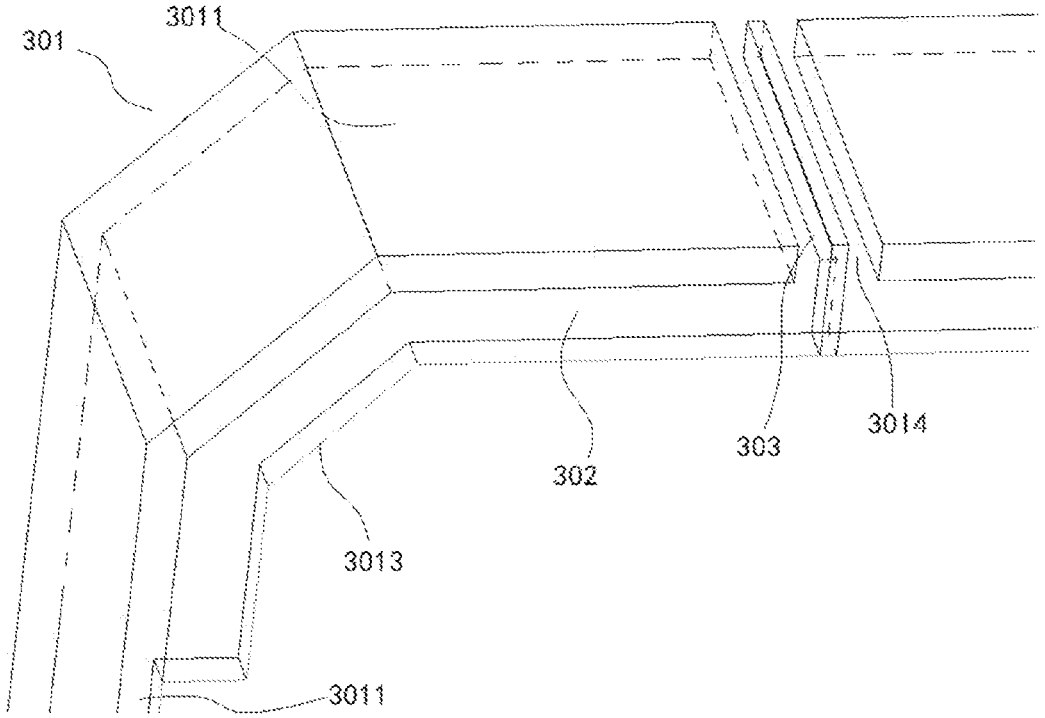
FIG. 3B is a schematic stereoscopic structural diagram of a mobile terminal antenna according to some embodiments of the present disclosure.

FIG. 3A and FIG. 3B show schematic structural diagrams of a mobile terminal antenna according to some embodiments of the present disclosure. The mobile terminal has a metal housing 301, and an open pattern 302 is provided on an inner side of an edge of the metal housing 301, so that a part of the edge of the metal housing 301 is separated from the metal housing, where a part of the separated edge forms a second section 3011 of a metal frame. Parts of the metal housing 301 not provided with an open pattern serve as a first section 3012 of the metal frame and a main ground board 3013. An opening 3014 is provided in the second section 3011, and an isolation sheet 303 is provided in the opening 3014. Portions of the second section 3011 of the metal frame on two sides of the opening 3014 are connected with a grounding terminal 304 or the main ground board 3013, to form antenna arms. Each antenna arm is connected with a feed 304 and a grounding point 3015 is provided on the antenna arm between two neighboring openings 3014. The isolation sheet 303 is a part of the metal housing 301 and is formed integrally with the main ground board 3013.

A mobile terminal is provided according to the present disclosure, which includes the mobile terminal antenna according to any of the above embodiments of the present disclosure.

Optionally, the mobile terminal includes a mobile terminal antenna, and the mobile terminal antenna includes a main ground board, an isolation sheet and a metal frame arranged surrounding the main ground board;

the main ground board is arranged within a region defined by the metal frame;

the metal frame includes a first section connected with the main ground board and a second section separated from the main ground board, at least one opening is provided in the second section, and portions of the metal frame on two sides of each opening are each connected with a grounding terminal and a feed, so that the portions of the metal frame on the two sides of the opening each form at least one antenna arm; and the isolation sheet is arranged in the opening and connected with the grounding terminal.

Optionally, in a case that two or more openings are provided in the mobile terminal antenna, a grounding point is provided on a portion of the second section of the metal frame between two neighboring openings, and the grounding point is connected with the grounding terminal, so that the portion of the second section of the metal frame between two neighboring openings is divided by the grounding point to form two antenna arms.

Optionally, at least one antenna arm is connected with the main ground board via the first section of the metal frame, and the main ground board serves as an equivalent grounding terminal.

Optionally, a thickness of the isolation sheet is smaller than 1 mm.

Optionally, a distance between the isolation sheet and the antenna arm at each side of the isolation sheet is greater than 0.5 mm.

Optionally, a resonant frequency of each isolation sheet and its grounded part is higher than a maximum operation frequency of the antenna at each side of the isolation sheet.

Optionally, a path connecting the isolation sheet to the grounding terminal is shorter than a path connecting the antenna arm to the grounding terminal.

Optionally, an insulation layer is provided surrounding the isolation sheet and the isolation sheet is wrapped by the insulation layer.

Optionally, the isolation sheet, the main ground board and the first section of the metal frame are connected to form an integral structure, and both ends of the first section of the metal frame and respective closest antenna arms are connected to form an integral structure.

Figure 4:
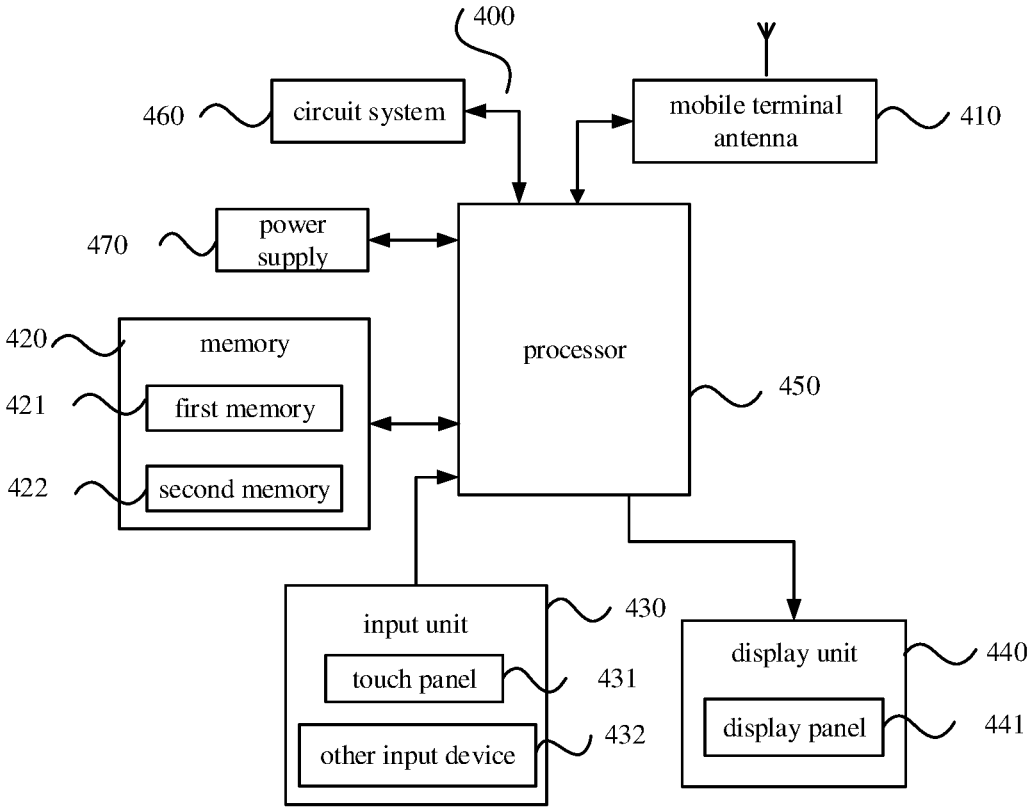
FIG. 4 is a schematic structural diagram of a mobile terminal according to some embodiments of the present disclosure.

FIG. 4 is a schematic structural diagram of a mobile terminal according to some embodiments of the present disclosure. The mobile terminal 400 in FIG. 4 may be a mobile phone, a tablet computer, a personal digital assistant (Personal Digital Assistant, PDA), a MP3 player or an on-board computer.

The mobile terminal in FIG. 4 includes an antenna 410, a memory 420, an input unit 430, a display unit 440, a processor 450, a circuit system 460 and a power supply 470.

The input unit 430 may be configured to receive numeric or character information inputted by a user, and to generate signal inputs related to user settings and function control of the mobile terminal 400. Specifically, in an embodiment of the present disclosure, the input unit 430 may include a touch panel 431. The touch panel 431, also referred to as a touch screen, may collect touch operations from the user on or near the touch panel (such as an operation performed by the user using any suitable object or accessory such as a finger or a stylus on the touch panel 431), and drive a corresponding connection apparatus according to a preset program. Optionally, the touch panel 431 may include two parts: a touch detection apparatus and a touch controller. The touch detection apparatus detects a touch position of the user, detects a signal brought by the touch operation, and transmits the signal to the touch controller; and the touch controller receives the touch information from the touch detection device, converts the touch information into contact coordinates, and sends the contact coordinates to the processor 450, and may receive and execute commands from the processor 450. In addition, the touch panel 431 may be implemented in various types such as resistive, capacitive, infrared, and surface acoustic waves. In addition to the touch panel 431, the input unit 430 may further include other input device 432. Other input device 432 may include, but not limited to, one or more of a physical keyboard, a function button (such as a volume control button or a switch button), a trackball, a mouse, or a joystick.

The display unit 440 may be configured to display information inputted by the user or information provided for the user and various menu interfaces of the mobile terminal 400. The display unit 440 may include a display panel 441. Optionally, the display panel 441 may be configured in the form of LCD or organic light-emitting diode (Organic Light-Emitting Diode, OLED).

It should be noted that the touch panel 431 may cover the display panel 441 to form a touch display screen, and when the touch display screen detects a touch operation on or near it, the touch operation is transmitted to the processor 460 to determine the type of the touch event, and then the processor 460 provides a corresponding visual output on the touch display screen based on the type of touch event.

The touch display screen includes an application interface display region and a common control display region. The arrangement of the application interface display region and the common control display region is not limited, which may be up-and-down arrangement or left-and-right arrangement, as long as it can distinguish the two display regions. The application interface display region may be used to display interfaces of applications. Each interface may include interface elements such as at least one application icon and/or widget desktop control. The application interface display region may also be an empty interface that does not contain any content. The common control display region is used to display controls with high usage, such as setting button, interface number, scroll bar, or application icon such as phone book icon.

The processor 460 is the control center of the mobile terminal 400, which connects various parts of the entire mobile phone by using various interfaces and wires, performs functions of the mobile terminal 400 and processes data by running or executing software programs and/or modules stored in a first memory 421 and invoking data stored in a second memory 422, thereby performing overall monitoring on the mobile terminal 400. Optionally, the processor 460 may include one or more processing units.

In an embodiment of the present disclosure, the mobile terminal antenna 410 includes a main ground board, an isolation sheet and a metal frame surrounding the main ground board;

the main ground board is arranged within the metal frame, a part of an edge of the main ground board is connected with an inner edge of the metal frame, and another part of the edge is separated from the inner edge of the metal frame;

the metal frame includes a first section and a second section, an inner edge of the metal frame corresponding to the first section is connected with the edge of the main ground board, an inner edge of the metal frame corresponding to the second section is separated from the edge of the main ground board, at least one opening is provided in the second section, portions of the metal frame on two sides of each opening are each connected with a grounding terminal and a feed, so that the portions of the metal frame on the two sides of the opening each form at least one antenna arm; and the isolation sheet is arranged in the opening and connected with the grounding terminal.

Optionally, in a case that two or more openings are provided in the mobile terminal antenna, a grounding point is provided on a portion of the metal frame between two neighboring openings, and the grounding point is connected with the grounding terminal, so that a portion of the second section of the metal frame between two neighboring openings is divided by the grounding point to form two antenna arms.

Optionally, at least one antenna arm is connected with the main ground board via the first section of the metal frame, so that the main ground board serves as an equivalent grounding terminal of the antenna arm.

Optionally, a thickness of the isolation sheet is smaller than 1 mm.

Optionally, a distance between the isolation sheet and an antenna arm at each side of the isolation sheet is greater than 0.5 mm.

Optionally, a resonant frequency of each isolation sheet and its grounded part is higher than a maximum operation frequency of the antenna at each side of the isolation sheet.

Optionally, a path connecting the isolation sheet to the grounding terminal is shorter than a path connecting the antenna arm to the grounding terminal.

Optionally, the isolation sheet is made of metal, an insulation layer is provided surrounding the isolation sheet and the isolation sheet is wrapped by the insulation layer.

Optionally, the isolation sheet, the main ground board and the first section of the metal frame are connected to form an integral structure, and two ends of the first section of the metal frame and respective closest antenna arms are connected to form an integral structure.

Those of ordinary skill in the art will recognize that, the exemplary units and algorithm steps of the various embodiments described above may be implemented by electronic hardware, or by a combination of computer software and electronic hardware. Whether these functions are implemented by hardware or software depends on the specific application and design constraints of the solution. A skilled person may use different methods to implement the described functions for each particular application, and such implementations are not to be considered as departing from the scope of the present disclosure.

The skilled person should appreciate that, for the sake of easiness and conciseness of description, the specific operating processes of the aforementioned systems, devices and units may be understood by referring to the corresponding processes of the foregoing method embodiments, and a repeated description thereof is omitted herein.

It should be appreciated that the device and method disclosed in the embodiments provided by this application may be implemented by other means. For example, the aforementioned device embodiment is merely illustrative, e.g., the units are merely divided in logic function, which may be divided in another way in actual implementation, such as multiple units or components may be combined or integrated into another system, or some features may be ignored or not performed. Furthermore, the shown or discussed mutual coupling or direct coupling or communication connection can be achieved by indirect coupling or communication connection through some interfaces, devices or units, which may be implemented in electric, mechanical or other ways.

The units described as separate components may be or not be physically separated, and the components displayed as units may or may not be physical units, that is, may be located in one place, or may be distributed over multiple network units. Some or all of the units may be selected according to actual needs to realize the object of the solution of the embodiments.

Additionally, the functional units in the various embodiments of the present disclosure may be integrated in one processing unit, or each unit may be physically present alone, or two or more units may be integrated in one unit.

If the function is implemented in the form of a software functional unit, and sold or used as a standalone product, the unit may be stored in a computer readable storage medium. Based on this understanding, essence of the technical solution of the present disclosure, or the part contributing to the related technologies, or part of the technical solution, can be embodied in the form of a software product. The computer software product is stored in a storage media, and the computer software product includes a number of instructions to enable a computer device (which may be personal computer, server, or network device, etc.) to perform all or part of the steps of the method described in the various embodiments of the present disclosure. The storage medium includes a USB flash disk, a mobile hard disk, a read-only memory (ROM), a random access memory (RAM), a magnetic disk, an optical disk, and other medium which can store program code.

The aforementioned are merely specific implementations of the present disclosure, and the protection scope of the present disclosure is not limited thereto. Any modifications or replacements that would easily occur to those skilled in the art, without departing from the technical scope disclosed in the present disclosure, should be encompassed in the protection scope of the present disclosure. Therefore, the protection scope of the present disclosure is to be determined by the protection scope of the claims.

What is claimed is:

1. A mobile terminal antenna, comprising:

a main ground board, an isolation sheet and a metal frame surrounding the main ground board;

wherein the main ground board is arranged within the metal frame;

wherein the metal frame comprises a first section and a second section, an inner edge of the metal frame corresponding to the first section is connected with an edge of the main ground board, an inner edge of the metal frame corresponding to the second section is separated from the edge of the main ground board, at least one opening is provided in the second section, portions of the metal frame on two sides of each opening are each connected with a grounding terminal and a feed, such that the portions of the metal frame on the two sides of the opening each form at least one antenna arm; and wherein the isolation sheet is arranged in the opening and connected with the grounding terminal;

wherein a path connecting the isolation sheet to the grounding terminal is shorter than a path connecting the antenna arm to the grounding terminal.

2. The mobile terminal antenna according to claim 1, wherein in a case that the quantity of the at least one opening is two or more, a grounding point is provided on a portion of the metal frame between two neighboring openings, and the grounding point is connected with the grounding terminal, such that the portion of the metal frame between the two neighboring openings is divided by the grounding point to form two antenna arms.

3. The mobile terminal antenna according to claim 1, wherein at least one antenna arm is connected with the main ground board via the first section of the metal frame, such that the main ground board serves as an equivalent grounding terminal of the antenna arm.

4. The mobile terminal antenna according to claim 1, wherein a thickness of the isolation sheet is smaller than 1 mm.

5. The mobile terminal antenna according to claim 1, wherein a distance between the isolation sheet and the antenna arm at each side of the isolation sheet is greater than 0.5 mm.

6. The mobile terminal antenna according to claim 1, wherein a resonant frequency of each isolation sheet and a grounded part of the isolation sheet is higher than a maximum operation frequency of the antenna arm at each side of the isolation sheet.

7. The mobile terminal antenna according to claim 1, wherein the isolation sheet is made of metal, an insulation layer is provided surrounding the isolation sheet and the isolation sheet is wrapped by the insulation layer.

8. The mobile terminal antenna according to claim 1, wherein the isolation sheet, the main ground board and the first section of the metal frame are an integrally formed structure, and two ends of the first section of the metal frame and respective closest antenna arms are an integrally formed structure.

9. The mobile terminal antenna according to claim 1, wherein in a case that the quantity of the at least one opening is two or more, a grounding point is provided on a portion of the metal frame between two neighboring openings, and the grounding point is connected with the grounding terminal, such that the portion of the metal frame between the two neighboring openings is divided by the grounding point to form two antenna arms; wherein the grounding point is between two feeds connected with the portion of the metal frame between the two neighboring openings.

10. A mobile terminal, comprising a mobile terminal antenna, wherein the mobile terminal antenna comprises: a main ground board, an isolation sheet and a metal frame surrounding the main ground board;

wherein the main ground board is arranged within the metal frame;

wherein the metal frame comprises a first section and a second section, an inner edge of the metal frame corresponding to the first section is connected with an edge of the main ground board, an inner edge of the metal frame corresponding to the second section is separated from the edge of the main ground board, at least one opening is provided in the second section, portions of the metal frame on two sides of each opening are each connected with a grounding terminal and a feed, such that the portions of the metal frame on the two sides of the opening each form at least one antenna arm; and wherein the isolation sheet is arranged in the opening and connected with the grounding terminal;

wherein a path connecting the isolation sheet to the grounding terminal is shorter than a path connecting the antenna arm to the grounding terminal.

11. The mobile terminal according to claim 10, wherein in a case that the quantity of the at least one opening is two or more, a grounding point is provided on a portion of the metal frame between two neighboring openings, and the grounding point is connected with the grounding terminal, such that the portion of the metal frame between the two neighboring openings is divided by the grounding point to form two antenna arms.

12. The mobile terminal according to claim 10, wherein at least one antenna arm is connected with the main ground board via the first section of the metal frame, such that the main ground board serves as an equivalent grounding terminal of the antenna arm.

13. The mobile terminal according to claim 10, wherein a thickness of the isolation sheet is smaller than 1 mm.

14. The mobile terminal according to claim 10, wherein a distance between the isolation sheet and the antenna arm at each side of the isolation sheet is greater than 0.5 mm.

15. The mobile terminal according to claim 10, wherein a resonant frequency of each isolation sheet and a grounded part of the isolation sheet is higher than a maximum operation frequency of the antenna arm at each side of the isolation sheet.

16. The mobile terminal according to claim 10, wherein the isolation sheet is made of metal, an insulation layer is provided surrounding the isolation sheet and the isolation sheet is wrapped by the insulation layer.

17. The mobile terminal according to claim 10, wherein the isolation sheet, the main ground board and the first section of the metal frame are an integrally formed structure, and two ends of the first section of the metal frame and respective closest antenna arms are an integrally formed structure.

18. The mobile terminal according to claim 10, wherein in a case that the quantity of the at least one opening is two or more, a grounding point is provided on a portion of the metal frame between two neighboring openings, and the grounding point is connected with the grounding terminal, such that the portion of the metal frame between the two neighboring openings is divided by the grounding point to form two antenna arms; wherein the grounding point is between two feeds connected with the portion of the metal frame between the two neighboring openings.

* * * * *